US010020100B2

(12) United States Patent
Ishii

(10) Patent No.: US 10,020,100 B2
(45) Date of Patent: Jul. 10, 2018

(54) R-T-B-BASED ALLOY POWDER AND METHOD FOR PRODUCING SAME, AND R-T-B-BASED SINTERED MAGNET AND METHOD FOR PRODUCING SAME

(71) Applicant: HITACHI METALS, LTD., Minato-ku, Tokyo (JP)

(72) Inventor: Rintaro Ishii, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/128,137

(22) PCT Filed: Mar. 23, 2015

(86) PCT No.: PCT/JP2015/058686
§ 371 (c)(1),
(2) Date: Sep. 22, 2016

(87) PCT Pub. No.: WO2015/146888
PCT Pub. Date: Oct. 1, 2015

(65) Prior Publication Data

US 2017/0098497 A1 Apr. 6, 2017

(30) Foreign Application Priority Data

Mar. 27, 2014 (JP) ..... 2014-065851

(51) Int. Cl.
*B22F 9/04* (2006.01)
*H01F 1/057* (2006.01)
(Continued)

(52) U.S. Cl.
CPC ..... *H01F 1/0577* (2013.01); *B22F 1/0003* (2013.01); *B22F 1/0011* (2013.01);
(Continued)

(58) Field of Classification Search
None
See application file for complete search history.

(56) References Cited

U.S. PATENT DOCUMENTS 5,858,123 A * 1/1999 Uchida ..... B22F 9/04 148/302
2004/0079449 A1 4/2004 Kanekiyo et al.
(Continued)

FOREIGN PATENT DOCUMENTS

EP 1 154 444 A1 11/2001
JP 63-004001 A 1/1988
(Continued)

OTHER PUBLICATIONS

Official Communication issued in International Patent Application No. PCT/JP2015/058686, dated Jun. 9, 2015.

*Primary Examiner* — George Wyszomierski
(74) *Attorney, Agent, or Firm* — Keating & Bennett, LLP

(57) ABSTRACT

A method is provided for producing an R-T-B based alloy powder. The method includes providing an alloy powder containing 27.5 to 36.0 mass % of R, where R is at least one among the rare-earth elements and always includes at least one of Nd and Pr, 0.85 to 1.05 mass % of B, 0.1 to 2.5 mass % of element M (Al, Ti, V, Cr, Mn, Ni, Cu, Zn, Ga, Zr, Nb, Mo, Ag, In, Sn, Hf, Ta, W, Pb and/or Bi), and a balance T, where T is Fe or is Fe and Co; and pulverizing the powder by introducing the powder and a pulverization gas in a pulverization chamber. The pulverization includes attrition while circulating the alloy powder with a flow of the pulverization gas in the pulverization chamber. The pulverization gas has a gauge pressure of 0.75 MPa or more, and the residence time is 6 minutes or more.

3 Claims, 3 Drawing Sheets

(51) Int. Cl.

| | |
|---|---|
| ***C22C 38/16*** | (2006.01) |
| ***C22C 38/14*** | (2006.01) |
| ***C22C 38/12*** | (2006.01) |
| ***C22C 38/10*** | (2006.01) |
| ***C22C 38/06*** | (2006.01) |
| ***C22C 38/00*** | (2006.01) |
| ***C22C 33/02*** | (2006.01) |
| ***B22F 3/10*** | (2006.01) |
| ***B22F 1/00*** | (2006.01) |
| ***H01F 41/02*** | (2006.01) |

(52) U.S. Cl.

CPC ..... *B22F 1/0081* (2013.01); *B22F 3/1017* (2013.01); *B22F 9/04* (2013.01); *C22C 33/0278* (2013.01); *C22C 38/002* (2013.01); *C22C 38/005* (2013.01); *C22C 38/06* (2013.01); *C22C 38/10* (2013.01); *C22C 38/12* (2013.01); *C22C 38/14* (2013.01); *C22C 38/16* (2013.01); *H01F 41/0266* (2013.01); *B22F 2009/044* (2013.01); *B22F 2202/05* (2013.01); *B22F 2301/355* (2013.01); *B22F 2304/10* (2013.01); *B22F 2998/10* (2013.01)

(56) References Cited

U.S. PATENT DOCUMENTS

| | | | | |
|---|---|---|---|---|
| 2004/0177899 | A1* | 9/2004 | Nishizawa | C22C 1/0441 148/302 |
| 2005/0067058 | A1* | 3/2005 | Fujimori | C22C 38/005 148/302 |
| 2011/0025440 | A1* | 2/2011 | Kuniyoshi | C22C 33/0278 335/302 |
| 2011/0262297 | A1* | 10/2011 | Ishii | B22F 1/0014 419/23 |
| 2014/0328711 | A1* | 11/2014 | Sun | B22F 1/0081 419/20 |

FOREIGN PATENT DOCUMENTS

| | | | |
|---|---|---|---|
| JP | 05-135930 | A | 6/1993 |
| JP | 07-074012 | A | 3/1995 |
| JP | 09-143514 | A | 6/1997 |
| JP | 2003-049204 | A | 2/2003 |
| JP | 2003-138335 | A | 5/2003 |
| JP | 2007-266038 | A | 10/2007 |

* cited by examiner (a)

(b)

R-T-B-BASED ALLOY POWDER AND METHOD FOR PRODUCING SAME, AND R-T-B-BASED SINTERED MAGNET AND METHOD FOR PRODUCING SAME

TECHNICAL FIELD

The present invention relates to an R-T-B based alloy powder and a production method thereof, and to a sintered R-T-B based magnet and a production method thereof.

BACKGROUND ART

Sintered R-T-B based magnets (where R is a rare-earth element including Y; T is a transition element whose main component is Fe, and is specifically Fe or Fe and Co; and B is boron) are broadly used in various types of electronic equipment because they exhibit the highest magnetic energy product among various magnets and they are relatively inexpensive.

Sintered R-T-B based magnets are produced by the steps described below, for example.

First, a raw material alloy is produced by casting various raw material metals with a method such as an ingot method or a strip casting method. Next, the resultant raw material alloy is subjected to a pulverization step to obtain an alloy powder of a predetermined particle size. This pulverization step usually involves a coarse-pulverization step and a fine-pulverization step, the former being performed by utilizing e.g. the hydrogen embrittlement phenomenon, and the latter being performed by utilizing e.g. an jet mill (airflow pulverizer).

Next, the powder is subjected to a step of pressing in a magnetic field where it is molded into a desired shape while being in a magnetic field. The resultant compact is sintered, whereby a sintered R-T-B based magnet is produced. Moreover, the sintering is usually followed by a heat treatment.

In the step of pressing in a magnetic field, the aforementioned powder is molded while applying a magnetic field thereto in a predetermined direction, whereby the directions of easy magnetization of the respective powder particles are aligned in the direction of the applied magnetic field. Enhancing the degree of alignment (alignment degree) of the axes of easy magnetization of main phase crystal grains of the sintered R-T-B based magnet to be finally obtained allows a sintered R-T-B based magnet with high remanence $B_r$ to be obtained.

Patent Document 1 discloses use of a counter jet mill which, in addition to a principal pulverization gas that is introduced through a pulverization gas nozzle, introduces a circulation-generating gas through a separately provided nozzle, whereby fine powder with obtuse ridges can be obtained. This fine powder has good slippage, which promotes the alignment degree of the fine powder when it is pressurized while applying a magnetic field thereto during compacting (or pressing).

Patent Document 2 discloses performing a heat treatment for finely-pulverized rare-earth alloy powder, prior to compacting in a magnetic field. The rare-earth alloy powder having been subjected to the heat treatment acquires a roundish shape due to sphericalization. This reduces the frictional force and steric hindrance during alignment in a magnetic field, thereby improving the alignment degree.

CITATION LIST

Patent Literature

[Patent Document 1] Japanese Laid-Open Patent Publication No. 2003-138335

[Patent Document 2] Japanese Laid-Open Patent Publication No. 2007-266038

SUMMARY OF INVENTION

Technical Problem

With the technique described in Patent Document 1, the resultant powder still has some angles, even though obtuse; thus, improvement in the alignment degree is insufficient.

The technique described in Patent Document 2, which includes a step of performing a heat treatment for finely-pulverized powder, has the problem of complicated production steps.

Furthermore, the technique described in Patent Document 2 poses a high possibility that particles of rare-earth alloy powder may stick with one another through the heat treatment, thus resulting in a problem of being unable to enhance the alignment degree.

The present invention has been made in view of the above problems, and an objective thereof is to provide: an R-T-B based alloy powder which is suitably used for producing a sintered R-T-B based magnet with more improved magnetic characteristics, and a production method thereof; and a sintered R-T-B based magnet for which the aforementioned R-T-B based alloy powder is used, and a production method thereof.

Solution to Problem

An R-T-B based alloy powder according to an embodiment of the present invention is an R-T-B based alloy powder which comprises not less than 27.5 mass % and not more than 36.0 mass % of R (where R is at least one among the rare-earth elements and always includes at least one of Nd and Pr), not less than 0.85 mass % and not more than 1.05 mass % of B (boron), not less than 0.1 mass % and not more than 2.5 mass % of element M (where M is at least one selected from the group consisting of Al, Ti, V, Cr, Mn, Ni, Cu, Zn, Ga, Zr, Nb, Mo, Ag, In, Sn, Hf, Ta, W, Pb and Bi), and a balance T (where T is a transition element whose main component is Fe, and is specifically Fe or Fe and Co), and in which powder satisfying the condition $L/d \leq 5.39-1.07(a/b)$ accounts for 20% or more by number ratio, given a ratio a/b between a longer diameter a and a shorter diameter b and a ratio L/d between a circumferential length L and an equivalent circular diameter d (which is a diameter of a circle of an identical area) of contour shapes resulting from two-dimensional projection of particles.

In one embodiment, the powder satisfying the condition $L/d \leq 5.39-1.07(a/b)$ accounts for 40% or more by number ratio.

A sintered R-T-B based magnet according to an embodiment of the present invention is obtained by aligning the above R-T-B based alloy powder with an external magnetic field, and sintering the R-T-B based alloy powder.

A production method of an R-T-B based alloy powder according to an embodiment of the present invention comprises: a step of providing an alloy powder containing not less than 27.5 mass % and not more than 36.0 mass % of R (where R is at least one among the rare-earth elements and always includes at least one of Nd and Pr), not less than 0.85 mass % and not more than 1.05 mass % of B (boron), not less than 0.1 mass % and not more than 2.5 mass % of element M (where M is at least one selected from the group consisting of Al, Ti, V, Cr, Mn, Ni, Cu, Zn, Ga, Zr, Nb, Mo, Ag, In, Sn, Hf, Ta, W, Pb and Bi), and a balance T (where T is a transition element whose main component is Fe, and is specifically Fe or Fe and Co); and a step of pulverizing the alloy powder by introducing the alloy powder and a pulverization gas in a pulverization chamber, wherein the pulverization comprises attrition while circulating the alloy powder with a flow of the pulverization gas in the pulverization chamber, the pulverization step being performed so as to satisfy the condition that the pulverization gas to be introduced in the pulverization chamber has a gauge pressure of 0.65 MPa or more and that a residence time of the alloy powder in the pulverization chamber is 8 minutes or more, or satisfy the condition that the pulverization gas has a gauge pressure of 0.75 MPa or more and that the residence time is 5 minutes or more.

In one embodiment, the pulverization step is performed so as to satisfy the condition that the pulverization gas has a gauge pressure of 0.75 MPa or more and that the residence time is 5 minutes or more.

A production method of a sintered R-T-B based magnet according to an embodiment of the present invention comprises: a step of obtaining the above R-T-B based alloy powder; and a step of aligning the R-T-B based alloy powder with an external magnetic field and sintering the R-T-B based alloy powder.

Advantageous Effects of Invention

According to an embodiment of the present invention, there is provided an R-T-B based alloy powder with few angles and a sintered R-T-B based magnet with improved remanence $B_r$.

DESCRIPTION OF EMBODIMENTS

[R-T-B Based Alloy Powder]

Figure 1:
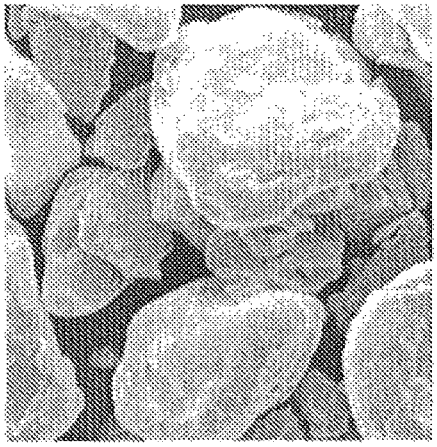
[FIG. 1] (*a*) is an SEM photograph of an R-T-B based alloy powder according to an embodiment of the present invention, and (*b*) is an SEM photograph of an R-T-B based alloy powder according to Comparative Example.
Figure 1:
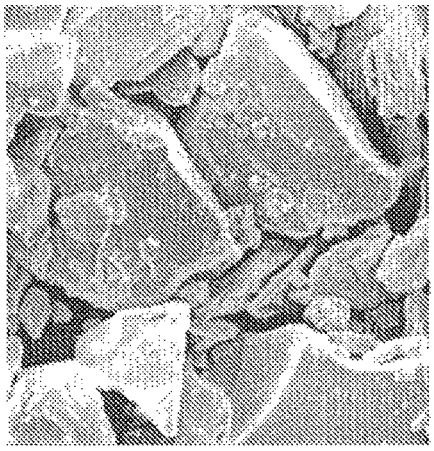

An R-T-B based alloy powder according to an embodiment of the present invention is an alloy powder in which powder satisfying the condition $L/d \leq 5.39-1.07(a/b)$ accounts for 20% or more, given a ratio a/b between a longer diameter a and a shorter diameter b and a ratio L/d between a circumferential length L and an equivalent circular diameter d (i.e., a diameter of a circle of an identical area) of contour shapes resulting from two-dimensional projection of particles of the alloy powder.

Herein, the longer diameter a represents the largest diameter of each contour shape, and the shorter diameter b represents the largest diameter of each contour shape in a direction orthogonal to the longer diameter.

As for the means with which to measure the longer diameter a, the shorter diameter b, the circumferential length L, and the equivalent circular diameter d of contour shapes resulting from two-dimensional projection of particles, without limitation, particles may be extracted from the picture of an SEM image of alloy powder, and contour shapes of the extracted particles can be analyzed with commercially-available image analysis software.

Preferably, alloy powder satisfying the condition $L/d \leq 5.39-1.07(a/b)$ accounts for 40% or more.

Moreover, the composition contains not less than 27.5 mass % and not more than 36.0 mass % of R (where R is at least one among the rare-earth elements and always includes at least one of Nd and Pr), not less than 0.85 mass % and not more than 1.05 mass % of B (boron), not less than 0.1 mass % and not more than 2.5 mass % of element M (where M is at least one selected from the group consisting of Al, Ti, V, Cr, Mn, Ni, Cu, Zn, Ga, Zr, Nb, Mo, Ag, In, Sn, Hf, Ta, W, Pb and Bi), and a balance T (where T is a transition element whose main component is Fe, and is specifically Fe or Fe and Co). M is preferably at least one selected from the group consisting of Al, Cu, Ga, Zr and Nb.

If the concentration of R is less than 27.5 mass %, it is difficult to generate a liquid phase in the sintering process. On the other hand, if the concentration of R exceeds 36.0 mass %, magnetization of the sintered R-T-B based magnet will be significantly hindered. The concentration of R is preferably not less than 28.5 mass % and not more than 33.0 mass %.

If the concentration of B is less than 0.85 mass %, a soft magnetic phase may occur, thereby deteriorating coercivity of the sintered R-T-B based magnet. On the other hand, if the concentration of B exceeds 1.05 mass %, a non-magnetic phase may occur, thereby hindering magnetization of the sintered R-T-B based magnet. The concentration of B is preferably not less than 0.90 mass % and not more than 1.05 mass %.

Element M is in the range of not less than 0.1 mass % and not more than 2.5 mass %, in which range significant deterioration of magnetization does not occur. The range of element M is preferably not less than 0.1 mass % and not more than 1.5 mass %, and still more preferably not less than 0.25 mass % and not more than 0.9 mass %.

T defines a balance. T is a transition element whose main component is Fe, and may contain Co. T is either Fe or Fe and Co; within a total of Fe and Co, Fe accounts for 50 atom % or more.

Examples of inevitable impurities include O, C, N, H, Si, Ca, S, P, and the like. Any of these is preferably to be contained in as small an amount as is industrially possible, in order to attain a high magnet performance.

[Sintered R-T-B Based Magnet]

A sintered R-T-B based magnet according to an embodiment of the present invention is obtained by aligning the R-T-B based alloy powder with an external magnetic field, and sintering it.

[Production Method of the R-T-B Based Alloy Powder]

An R-T-B based alloy powder according to an embodiment of the present invention is produced through a step of, while allowing the alloy powder to circulate in a pulverization chamber of a pulverization apparatus, finely pulverizing the alloy powder through particle-to-particle attrition (friction grinding), thereby obtaining an R-T-B based alloy powder which contains not less than 27.5 mass % and not more than 36.0 mass % of R (where R is at least one among the rare-earth elements and always includes at least one of Nd and Pr), not less than 0.85 mass % and not more than 1.05 mass % of B (boron), not less than 0.1 mass % and not more than 2.5 mass % of element M (where M is at least one selected from the group consisting of Al, Ti, V, Cr, Mn, Ni, Cu, Zn, Ga, Zr, Nb, Mo, Ag, In, Sn, Hf, Ta, W, Pb and Bi), and a balance T (where T is a transition element whose main component is Fe, and is specifically Fe or Fe and Co). In the aforementioned step of fine pulverization, the alloy powder is allowed to be resident in the pulverization layer for 8 minutes or more if the pulverization gas introduced into the pulverization chamber is 0.65 MPa or greater in gauge pressure, or for 5 minutes or more if it is 0.75 MPa or greater.

As a result, the R-T-B based alloy powder which is obtained according to an embodiment of the present invention is likely to assume a shape with few angles.

Since an R-T-B based alloy powder according to an embodiment of the present invention has a shape with few angles, its steric hindrance is reduced, and the alloy powder is easy to rotate in a step of pressing in a magnetic field, whereby the alignment degree is improved. This improves the remanence $B_r$ of a sintered R-T-B based magnet that is produced by using this alloy powder.

Hereinafter, a more detailed embodiment of the present invention will be described with reference to the drawings; however, the present invention is not to be limited to the following embodiment.

[Master Alloy]

The master alloy may be produced by either an ingot method or a strip casting method, but it is preferably produced by a strip casting method, which is a quenching technique. As a result, α-Fe will not remain in the cast structure, thereby facilitating pulverization. The composition of the master alloy may be appropriately determined by taking into account any decrease in each element in the intermediate steps of the production process, so that the composition of the resultant R-T-B based alloy powder will be a predetermined composition.

[Pulverization]

The pulverization step involves two pulverization steps, i.e., a coarse-pulverization step and a fine-pulverization step.

First, the coarse-pulverization step will be described. Coarse pulverization of the master alloy can be achieved by mechanical pulverization techniques or hydrogen pulverization techniques.

Among these, it is preferable to coarsely pulverize the master alloy by a hydrogen pulverization technique which utilizes the hydrogen embrittlement phenomenon. This method creates fine cracks in the master alloy through an embrittlement phenomenon and a volumetric expansion phenomenon of the master alloy which are associated with hydrogen occlusion, thereby pulverizing the master alloy. The hydrogen pulverization technique is preferable because it provides a high probability of cracking at the grain boundaries. Under a high probability of cracking at the grain boundaries, there will only be one main phase crystal (2-14-1 compound) contained within the particle, thus resulting in a single direction of easy magnetization; this facilitates magnetic-field alignment and improves $B_r$.

The hydrogen pulverization technique is performed through exposure for a certain amount of time to pressurized hydrogen at room temperature, for example. Next, after elevating temperature to allow excess hydrogen to be released, it is cooled. The alloy powder after the hydrogen embrittlement internally includes a large number of cracks, which greatly increase the specific surface. Therefore, it is very active, and will undergo significant increase in oxygen amounts during handling in the atmospheric air. Thus, desirably, it is handled in an inert gas, such as $N_2$ or Ar. The grain size of the alloy powder that is obtained through the coarse-pulverization step is e.g. 500 μm or less.

After the coarse-pulverization step, and before a fine-pulverization step described below, a sieve or the like may be employed to keep the grain size in a certain range or below, for example.

In the subsequently-performed fine-pulverization step, while the alloy powder after the coarse pulverization is circulated in a pulverization chamber of a pulverization apparatus, it is finely pulverized through attrition (friction grinding).

As an example, a fine-pulverization step using a circulating flow pulverization apparatus is described below.

In an airflow pulverization approach using a circulating flow pulverization apparatus, a high-pressure pulverization gas is introduced in the interior of a pulverization chamber which is provided in the pulverization apparatus. As a result, a flow of gas that rapidly circulates inside the pulverization chamber is generated, and this gas flow causes the alloy powder to circulate in the pulverization chamber. Based on the pulverization approach using a circulating flow pulverization apparatus, during the circulation, an alloy powder with few angles is formed through attrition. Although $N_2$ gas is a commonly-used pulverization gas, rare gases such as He and Ar gases may also be used.

In the present specification, the circulating flow pulverization apparatus may broadly encompass, among those commonly referred to as jet mills, any jet mill that is of a type which performs pulverization mainly with rotational force, and more specifically those which provide attrition effects.

The residence time is defined as a period of time from the beginning of supply from a coarse-pulverized powder supply nozzle until alloy powder becomes observed in a recovery container (not shown).

The gas pressure to be introduced in the pulverization chamber represents a gauge pressure (i.e., a difference from the atmospheric pressure).

The pressure of the pulverization gas is preferably set to 0.75 MPa or more in gauge pressure. More preferably, it is not less than 0.75 MPa and not more than 1.5 MPa, and still more preferably not less than 0.75 MPa and not more than 0.95 MPa.

The residence time is preferably 5 minutes or more. It is more preferably not less than 5 minutes and not more than 10 minutes, and still more preferably not less than 6 minutes and not more than 10 minutes. In the present embodiment, a method of prolonging the residence time may be taken which ensures that the supply rate is smaller than conventional, for example.

By allowing the alloy powder within the pulverization chamber to be resident for 5 minutes or more in a circulating flow which is created by ejecting a pulverization gas of 0.75 MPa or more, an alloy powder from which angles are eliminated as a whole is obtained.

The D50 particle size of the alloy powder to be recovered after this fine-pulverization step is not less than 1.0 μm and not more than 5.5 μm (i.e., a powder particle size that as will be obtained by a dry dispersion laser diffraction technique, which is a volume-based median value), for example. Moreover, in order to obtain more improved magnetic characteristics in the present embodiment, the D50 particle size is preferably not less than 2.5 μm and not more than 5.0 μm, and more preferably not less than 2.51 μm and not more than 4.63 μm.

Hereinafter, details of the circulating flow pulverization apparatus to be used in the present embodiment will be described.

Figure 2:
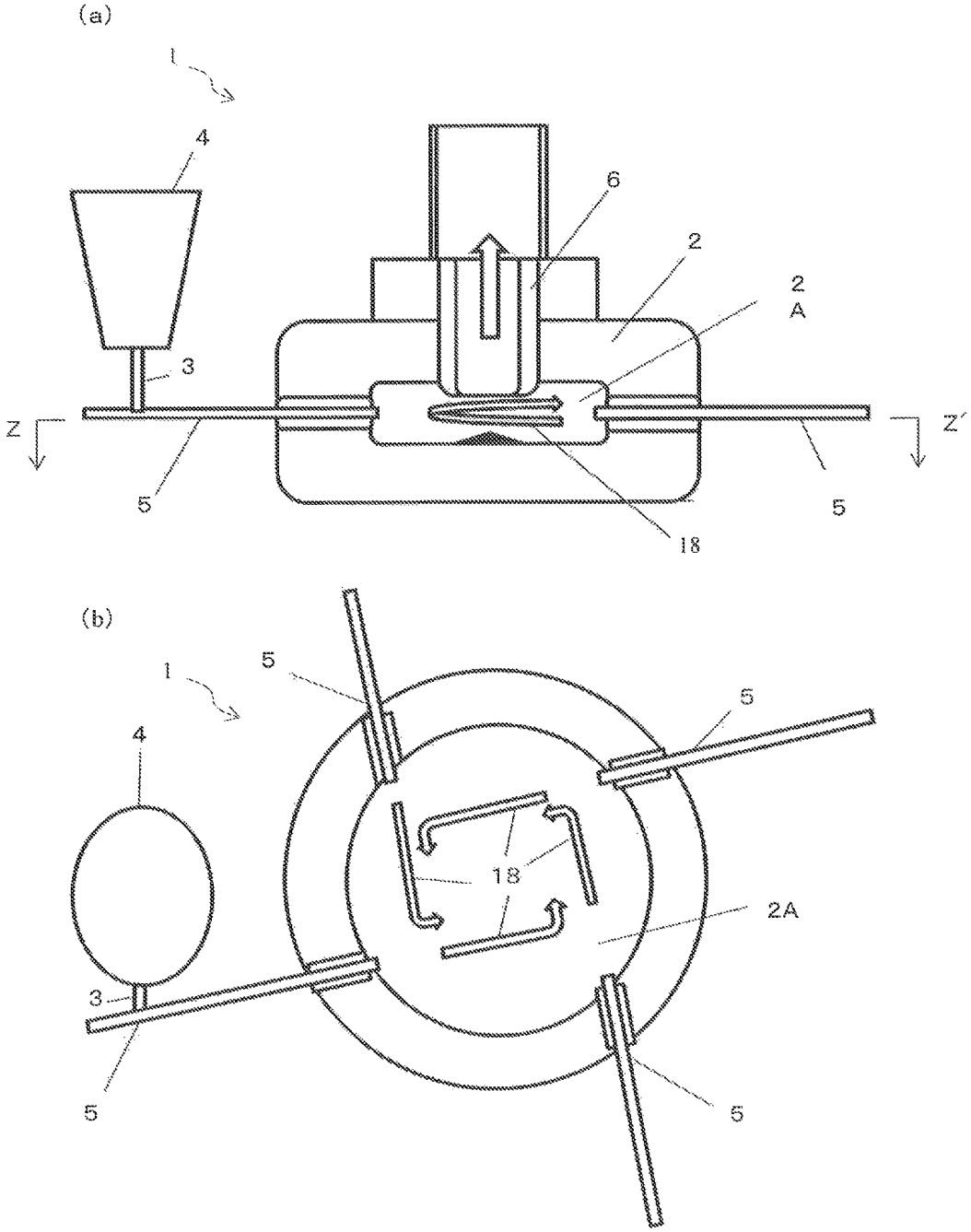
[FIG. 2] A schematic diagram showing the structure of a circulating flow pulverization apparatus which is used in an embodiment of the present invention, where (*a*) is a side cross-sectional view, and (*b*) is a Z-Z' cross-sectional view in (*a*).

FIG. 2(*a*) is a schematic diagram showing a circulating flow pulverization apparatus 1. FIG. 2(*b*) shows a cross section taken along line Z-Z' in FIG. 2(*a*). The circulating flow pulverization apparatus 1 includes a pulverization chamber 2A to accommodate the pulverization gas and pulverized powder circulating in its interior. Herein, the pulverization chamber 2A is a space that is enclosed by a housing 2.

A plurality of pulverization gas introduction nozzles 5 which communicate with the pulverization chamber 2A are attached to the housing 2. The pulverization gas introduction nozzles 5 are fixedly installed, with their mouths oriented toward the interior of the pulverization chamber 2A (although in a direction that is deviated from the center).

As shown in FIGS. 2(*a*) and (*b*), a coarse-pulverized powder supply port 3 for supplying coarsely-pulverized alloy powder into the pulverization chamber is disposed on one of the pulverization gas introduction nozzles 5. With the coarse-pulverized powder supply port 3, the alloy powder which has been supplied from the coarse-pulverized powder supplying section 4 in the shape of a hopper is ejected/introduced into the pulverization chamber 2A, together with the rapid pulverization gas which is ejected from the pulverization gas introduction nozzles 5.

To each of the pulverization gas introduction nozzles 5, a high-pressure gas (pulverization gas) is sent from a high-pressure gas supplier which is not shown, via a flue.

In the present embodiment, the aforementioned high-pressure gas supplier is arranged so that the pressure of the pulverization gas to be supplied to the pulverization chamber 2A can be made 0.75 MPa or more in gauge pressure.

The alloy powder which has been introduced in the interior of the pulverization chamber 2A becomes trapped in a high speed circulating flow 18 that is generated by the gas which has been blown out of the plurality of pulverization gas introduction nozzles 5 provided along the inner side wall, and circulates within the pulverization chamber 2A. At this time, the alloy powder becomes pulverized through attrition.

While being resident for a predetermined amount of time in the pulverization chamber 2A of the circulating flow pulverization apparatus 1, an R-T-B based alloy powder with few angles is produced.

Then, once its resident amount in the pulverization chamber reaches a certain level or greater, the R-T-B based alloy powder which has been obtained through pulverization is taken out through a fine-pulverized powder discharge port 6, which is located above the central portion of the pulverization chamber 2A.

With the constitution shown in FIGS. 2(*a*) and (*b*), the amount of alloy powder that can stay resident in the pulverization chamber 2A is fixed for each apparatus and each operating condition. If any alloy powder beyond that amount is introduced into the pulverization chamber 2A, an amount of alloy powder that corresponds to the introduced amount is discharge out of the chamber. Thus, by adjusting the amount that is introduced into the pulverization chamber 2A, the residence time of the powder in the pulverization chamber can be adjusted.

[Production Method of the Sintered R-T-B Based Magnet]

[Alignment of Main Phase Crystals with an External Magnetic Field]

The R-T-B based alloy powder is aligned with an external magnetic field.

As used herein, the alignment with an external magnetic field may be performed with a metal mold press having a coil for magnetic field application, or, after filling a fill container with powder at high density, the main phase crystals in the R-T-B based alloy powder may be aligned with an external magnetic field. Moreover, after performing magnetic-field alignment in a fill container, a powder compact may be formed with an isostatic press.

The magnetic field to be applied may be a static magnetic field or a pulse magnetic field.

[Compacting]

In the case where a metal mold press is used, the density of the compact is set to e.g. not less than 3.7 g/cm$^3$ and not more than 4.7 g/cm$^3$. When it is adjusted in this range, it is easy to enhance the alignment degree while maintaining strength of the compact. If it is less than 3.7 g/cm$^3$, the alignment degree will be higher, but when performing compacting with a metal mold press, there may not be sufficient strength, so that cracks may occur during the handling of the compact. When it exceeds 4.7 g/cm$^3$, the compact will have high strength, but particle movement during magnetic-field compacting may be restrained, so that the alignment degree may be deteriorated.

When producing a compact of the aforementioned R-T-B based alloy powder by using a metal mold press or an isostatic press, in order to restrain carbon from being taken in, it is desirable to minimize the use of lubricants and the like. In order to enable degreasing in a sintering step (or any preceding step), a highly volatile lubricant is to be selected.

With an R-T-B based alloy powder according to an embodiment of the present invention, even if the amount of lubricant used is spared, or even when no lubricant is used, a high degree of alignment is attained.

Although there is no limitation, the pressure to be applied during compacting in a metal mold press or an isostatic press may be e.g. not less than 9.8 MPa, more preferably not less than 19.6 MPa, and not more than 245 MPa, more preferably not more than 147 MPa.

[Sintering]

Preferably, the sintering step is performed in a sintering furnace in which an inert gas ambient in a vacuum or at the atmospheric pressure or below is kept. As used herein, the inert gas refers to an Ar or He gas. As for the method of retaining an inert gas ambient at the atmospheric pressure or below, a preferable method is to introduce a small amount of inert gas into the sintering furnace while performing evacuation with a vacuum pump. In this case, the evacuation may be performed intermittently, or the introduction of the inert gas may be performed intermittently. Moreover, the evacuation and the introduction may both be performed intermittently.

The sintering is usually performed by retaining the compact in a temperature range from 950° C. to 1100° C. for 30 minutes to 16 hours. Sintering may be separately performed plural times, at the same temperature or different temperatures. As for the condition of cooling after sintering, appropriate conditions may be combined so that the coercivity value of the resultant magnet attains a target value, including the heat treatment below.

Other than the aforementioned sintering method, any means of sintering used in powder metallurgy technology is also applicable, e.g., hot pressing of heating with an external application of pressure, or an electric current sintering which involves heating the compact via Joule heat. When these techniques are to be used, the sintering temperature and time are not limited to those mentioned above.

After sintering, it is preferable that the magnet, as a sinter, has a density of 7.3 g/cm$^3$ or more, and more preferably 7.5 g/cm$^3$ or more.

[Heat Treatment]

With a view to enhancing coercivity, after sintering is finished, a heat treatment may be performed at the sintering temperature or below. Moreover, such a heat treatment may be performed plural times at the same temperature or different temperatures. As the cooling conditions for the heat treatment, various conditions may be selected.

Note that, in the case where adequate coercivity is already attained after the sintering, there is no particular need to perform a heat treatment.

[Processing]

The magnet which has been obtained as a sinter may or may not have a shape close to that of the final product. Generally, the sintered R-T-B based magnet after the sintering is to be finished into a predetermined shape through machining, e.g., cutting, grinding or polishing. Note that this processing may take place any time after sintering, i.e., before or after a heat treatment, or in between plural heat treatments.

[Surface Treatment]

For antirust purposes, it is preferable to subject the resultant sintered R-T-B based magnet to a surface coating treatment. Examples of surface coating treatment include Ni plating, Sn plating, Zn plating, Al evaporation, Al alloy evaporation, resin coating, and the like.

Hereinafter, Examples of the present invention will be described.

EXAMPLE 1

To the main materials, which were Nd with a purity of 99.5% or more, electrolytic iron, and a low-carbon ferroboron alloy, additive elements (Co and M) were added as pure metals or as an alloy with Fe, and an alloy melt being melted so that the R-T-B based alloy powder and the sintered magnet had a final composition of Nd: 30.5, B: 0.94, Co: 0.9, Cu: 0.1, Al: 0.1, Ga: 0.1, and Fe: balance [mass %] was quenched by a strip casting method, whereby a plate-like alloy with a thickness of 0.1 to 0.3 mm was obtained.

This alloy was retained in a hydrogen-pressurized ambient by using a heat treatment furnace which was capable of pressurizing the alloy, and thereafter heated to 600° C. in a vacuum, and then cooled. After it was taken out of the furnace, a grain size adjustment was made with a sieve, whereby an alloy powder with a grain size of 425 μm or less was obtained.

Next, by using the circulating flow pulverization apparatus 1 shown in FIGS. 2(*a*) and 2(*b*), fine pulverization was conducted while varying the supply rate and the residence time; the pulverization conditions and the particle size (D50) of the resultant powders are shown in Table 1.

The pulverization chamber of the apparatus used in this Example had a volumetric capacity of 314 $cm^3$. Herein, the pulverization gas was an $N_2$ gas whose oxygen concentration was controlled to 8000 ppm or less. The pulverization gas pressure is a value expressing, in gauge pressure, the pressure of a pulverization gas to be introduced to the pulverization chamber.

The supply rate is the amount of alloy powder to be introduced in the pulverization chamber in 1 minute. The residence time is defined as an amount of time required from the beginning of supply from a coarse-pulverized powder supply nozzle until presence of alloy powder becomes observed in the recovery container (not shown), via a cyclone (not shown). An ability to recover in 4 minutes, however small the amount may be, is indicated as 4 minutes; on the other hand, an ability to recover in 6 minutes, without being able to recover in 4 minutes, is indicated as 6 minutes.

TABLE 1

| No | pulverization gas | gauge pressure (MPa) | supply rate (g/min) | residence time (min) | D50 (μm) |
|---|---|---|---|---|---|
| Sample 1 | nitrogen (oxygen introduced) | 0.75 | 4.1 | 6 | 4.51 |
| Sample 2 | | | 6.2 | 4 | 4.53 |

A photograph (SEM image) of the alloy powder of Sample 1 (Example), for which the pulverization gas had a pressure of 0.75 MPa and the residence time was 6 minutes, is shown in FIG. 1(*a*). As shown in FIG. 1(*a*), the alloy powder of Sample 1 had a surface with few angles, resulting in a shape which was roundish overall.

On the other hand, a photograph of the alloy powder of Sample 2 (Comparative Example), for which the gas pressure was 0.75 MPa and the residence time was 4 minutes, is shown in FIG. 1(*b*). As shown in FIG. 1(*b*), it can be observed that the alloy powder of Sample 2 is more angular than Sample 1.

In order to assess the shape of the powders of Example and Comparative Example, the contour shapes of particles obtained from two-dimensional projection of each SEM image of the alloy powder was analyzed with the image analysis software SCANDIUM (manufactured by OLYMPUS CORPORATION), to calculate longer diameter/shorter diameter (a/b) and circumferential length/equivalent circular diameter (L/d).

Table 2 shows a/b and L/d of some alloy powder which was arbitrarily extracted from the above alloy powder. In the alloy powder of Example, i.e., Sample 1 (particles a to m), the contour shapes resulting from two-dimensional projection of the respective particles from the SEM image satisfied the conditional expression $L/d \leq 5.39-1.07(a/b)$.

Figure 3:
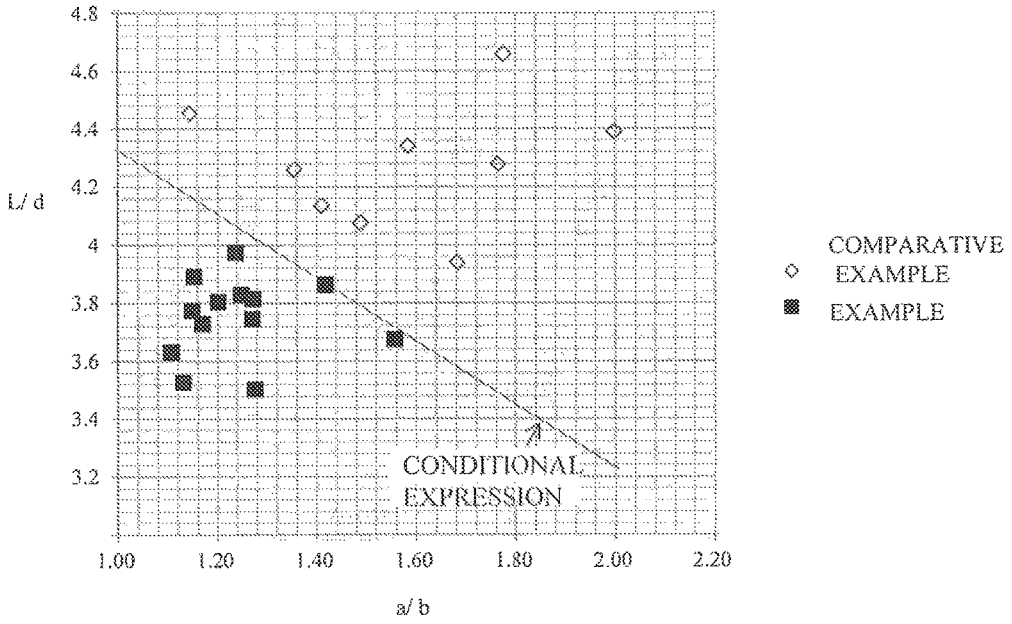
[FIG. 3] A diagram showing a relationship between a/b and L/d, as determined from a two-dimensional projection map of R-T-B based alloy powders of Example of the present invention and Comparative Example.

A distribution graph (scatter diagram) corresponding to the measurement results of Table 2 is shown in FIG. 3. It can be seen from this graph that the alloy powder of Example is in the lower left region of FIG. 3 above, where a/b and L/d satisfy the conditional expression according to the present invention.

On the other hand, it can be seen that the alloy powder of Comparative Example, i.e., Sample 2 (particles n to v) fails to satisfy the conditional expression $L/d \leq 5.39-1.07(a/b)$, i.e., not being contained in the lower left region of FIG. 3 above.

Mathematically speaking, when the shape is a circle, a/b equals 1 and L/d equals n.

TABLE 2

| Sample No | particle | longer diameter/shorter diameter [a/b] | circumferential length/equivalent circular diameter [L/d] |
|---|---|---|---|
| 1 (Example) | A | 1.15 | 3.89 |
| | B | 1.15 | 3.78 |
| | C | 1.24 | 3.97 |
| | d | 1.27 | 3.82 |
| | E | 1.42 | 3.86 |
| | F | 1.25 | 3.83 |
| | G | 1.11 | 3.63 |
| | H | 1.56 | 3.68 |
| | I | 1.20 | 3.80 |

TABLE 2-continued

| Sample No | particle | longer diameter/shorter diameter [a/b] | circumferential length/equivalent circular diameter [L/d] |
|---|---|---|---|
| | j | 1.28 | 3.50 |
| | K | 1.27 | 3.75 |
| | L | 1.17 | 3.73 |
| | M | 1.13 | 3.53 |
| 2 (Comparative Example) | N | 1.58 | 4.34 |
| | O | 1.41 | 4.14 |
| | P | 1.77 | 4.65 |
| | q | 1.68 | 3.94 |
| | R | 1.76 | 4.30 |
| | S | 1.35 | 4.26 |
| | T | 2.00 | 4.39 |
| | U | 1.49 | 4.08 |
| | V | 1.14 | 4.46 |

After 0.16 mass % of methyl caprylate was added to the alloy powder (Sample 1) of Example and to the alloy powder (Sample 2) of Comparative Example, under conditions such that the direction of the applied magnetic field was orthogonal to the direction of pressurization in a 1.36 MA/m magnetic field, compacts of Sample 1 (Example) and Sample 2 (Comparative Example) as indicated in Table 3 below were produced at a compacting pressure of 25 MPa.

Then, Samples 1 and 2 were sintered in a reduced-pressure Ar gas ambient, under the conditions of 1080° C. and four hours. Furthermore, the resultant sintered R-T-B based magnets were subjected to two hours of heat treatment at 500° C. in a vacuum ambient, and thereafter cooled.

After machining these Samples, their remanence $B_r$ and coercivity $H_{cJ}$ at room temperature were measured with a B-H tracer. The alignment degree of a sintered R-T-B based magnet is a value which is calculated as a tri-directional alignment degree $(B_{rx}/(B_{rx}^2+B_{ry}^2+B_{rz}^2)^{1/2})$, that is, a ratio of $B_{rx}$ to $(B_{rx}^2+B_{ry}^2+B_{rz}^2)^{1/2}$ where: given an X axis direction which is the direction of easy magnetization of the resultant sintered R-T-B based magnet, $B_{rx}$ is a remanence along the X axis direction; and $B_{ry}$ and $B_{rz}$ are remanences along two directions which are orthogonal to the direction of the aligning magnetic field.

On the other hand, the compact density and the sinter density in the table are values which are calculated from measurement results of dimensions and mass.

TABLE 3

| No | compacting pressure (MPa) | compact density (g/cm$^3$) | sinter density (g/cm$^3$) | Br (T) | HcJ (kA/m) | alignment degree |
|---|---|---|---|---|---|---|
| Sample 1 | 25 | 4.40 | 7.59 | 1.442 | 954 | 0.992 |
| Sample 2 | 25 | 4.20 | 7.58 | 1.429 | 926 | 0.989 |

As indicated by Table 3, although being of the same composition as and having a higher compact density than those of Sample 2 (Comparative Example), Sample 1 (Example) has improved values of remanence $B_r$, coercivity $H_{cJ}$, and alignment degree.

It is presumable that, since Sample 1 is powder which does not have angles, particles were easier to move during pressing in a magnetic field, whereby a high alignment degree was attained to result in the improved $B_r$.

EXAMPLE 2

To the main materials, which were Nd with a purity of 99.5% or more, electrolytic iron, and a low-carbon ferroboron alloy, additive elements (Co and M) were added as pure metals or as an alloy with Fe, and an alloy melt being melted so that the R-T-B based alloy powder and the sintered magnet had a final composition of Nd: 29.1, B: 0.94, Co: 0.9, Cu: 0.1, Al: 0.1, Ga: 0.1, and Fe: balance [mass %] was quenched by a strip casting method, whereby a plate-like alloy with a thickness of 0.1 to 0.3 mm was obtained.

This alloy was retained in a hydrogen-pressurized ambient by using a heat treatment furnace which was capable of pressurizing the alloy, and thereafter heated to 600° C. in a vacuum, and then cooled. After it was taken out of the furnace, a grain size adjustment was made with a sieve, whereby an alloy powder with a grain size of 425 μm or less was obtained.

The pulverization chamber of the apparatus used in this Example had a volumetric capacity of 314 cm$^3$. Herein, the pulverization gas was nitrogen gas. The pulverization gas pressure is a value expressing, in gauge pressure, the pressure of a pulverization gas to be introduced to the pulverization chamber.

By using the circulating flow pulverization apparatus 1 shown in FIGS. 2(*a*) and 2(*b*), fine pulverization was conducted while varying the supply rate and the residence time; the pulverization conditions and the particle size (D50) of the resultant powders are shown in Table 4.

As for Samples 3 to 12 shown in Table 4, after oxidization of the pulverized powder, from ten randomly-extracted particles of alloy powder for each Sample, contour shapes of the particles resulting from two-dimensional projection were assessed with commercially-available analysis software to assess whether the conditional expression $L/d \leq 5.39-1.07(a/b)$ was satisfied or not, and the proportion of the alloy powder that satisfied the conditional expression is shown.

TABLE 4

| No | Pulverizetion gas | gauge pressure (MPa) | supply rate (g/min) | residence time (min) | D50 (μm) | proportion of alloy powder satisfying the conditional expression (%) |
|---|---|---|---|---|---|---|
| Sample 3 | nitrogen | 0.65 | 5.9 | 4 | 5.04 | 0 |
| Sample 4 | | | 4.1 | 6 | 5.02 | 0 |
| Sample 5 | | | 3.1 | 8 | 5.02 | 20 |
| Sample 6 | | 0.75 | 6.0 | 4 | 4.53 | 0 |
| Sample 7 | | | 4.0 | 6 | 4.51 | 100 |
| Sample 8 | | | 2.9 | 8 | 4.51 | 100 |
| Sample 9 | | | 2.4 | 10 | 4.50 | 100 |
| Sample 10 | | 0.85 | 6.1 | 4 | 4.03 | 0 |
| Sample 11 | | | 4.0 | 6 | 4.00 | 100 |
| Sample 12 | | 0.95 | 6.1 | 4 | 3.53 | 0 |
| Sample 13 | | | 4.7 | 5 | 3.52 | 40 |
| Sample 14 | | | 4 | 6 | 3.51 | 100 |

As shown in Table 4 above, Sample 5 contained alloy powder satisfying the conditional expression by 20%, whereas Sample 13 contained alloy powder satisfying the conditional expression by 40%. As used herein, a "proportion of alloy powder satisfying the condition" is determined as the number of particles of powder satisfying the condition against the number of all particles in the measured powder (i.e., a number ratio).

Samples 7 to 9, 11 and 14 contained alloy powder satisfying the conditional expression by 100%.

In order to measure magnetic characteristics, after the fine-pulverization step, slurries were made by using the alloy powders of Samples 3 to 14 with oil, and under conditions such that the direction of the applied magnetic field was orthogonal to the direction of pressurization in a 1.36 MA/m magnetic field, compacts were produced at a compacting pressure of 25 MPa.

Then, as indicated in Table 5, Samples 3 to 14 were sintered in a reduced-pressure Ar gas ambient, under the conditions of 1080° C. and four hours. Furthermore, the resultant sintered R-T-B based magnets were subjected to two hours of heat treatment at 500° C. in a vacuum ambient, and thereafter cooled.

After machining these Samples, their remanence $B_r$, coercivity $H_{cJ}$, and alignment degree at room temperature were measured with a B-H tracer. The alignment degree was calculated as a tri-directional alignment degree similarly to Example 1.

TABLE 5

| No | Br (T) | HcJ (kA/m) | alignment degree |
|---|---|---|---|
| Sample 3 | 1.434 | 908 | 0.988 |
| Sample 4 | 1.433 | 912 | 0.988 |
| Sample 5 | 1.440 | 914 | 0.989 |
| Sample 6 | 1.436 | 952 | 0.988 |
| Sample 7 | 1.455 | 961 | 0.992 |
| Sample 8 | 1.457 | 960 | 0.992 |
| Sample 9 | 1.457 | 962 | 0.992 |
| Sample 10 | 1.434 | 989 | 0.988 |
| Sample 11 | 1.456 | 997 | 0.992 |
| Sample 12 | 1.435 | 1028 | 0.988 |
| Sample 13 | 1.454 | 1036 | 0.992 |
| Sample 14 | 1.455 | 1037 | 0.992 |

As indicated by Table 4 and Table 5, Samples 3 and 4, for which the gauge pressure was 0.65 MPa, exhibited hardly any difference in their remanence $B_r$, coercivity $H_{cJ}$, and alignment degree between the residence time being 4 minutes and the residence time being 6 minutes. In Sample 5, for which the residence time was 8 minutes, the remanence $B_r$, coercivity $H_{cJ}$, and alignment degree had improved.

In a comparison between Samples 6 to 9, for which the gauge pressure was 0.75 MPa, the remanence $B_r$, coercivity $H_{cJ}$, and alignment degree improved when the residence time was 6 minutes or more.

In a comparison between Samples 10 and 11, for which the gauge pressure was 0.85 MPa, Sample 11 with a residence time of 6 minutes were superior in remanence $B_r$, coercivity $H_{cJ}$, and alignment degree to Sample 10 with a residence time of 4 minutes.

In a comparison between Samples 12 to 14 for which the gauge pressure was 0.95 MPa, the remanence $B_r$, coercivity $H_{cJ}$, and alignment degree improved when the residence time was 5 minutes or more. It was indicated by Sample 13 that particularly excellent values of remanence $B_r$, coercivity $H_{cJ}$, and alignment degree were obtained when the proportion (number of particles) of powder satisfying the conditional expression $L/d \leq 5.39-1.07(a/b)$ was 40% or more.

While the above illustrates an example where the remanence $B_r$, coercivity $H_{cJ}$, and alignment degree would improve when an alloy powder in which powder satisfying $L/d \leq 5.39-1.07(a/b)$ accounted for 20% or more was obtained through the pulverization steps being performed by using a jet mill, any other method may be used to obtain a similar alloy powder.

EXAMPLE 3

To the main materials, which were Nd, Pr, Dy and Tb with a purity of 99.5% or more, electrolytic iron, and a low-carbon ferroboron alloy, additive element M was added as a pure metal or as an alloy with Fe, and an alloy melt being melted so that the R-T-B based alloy powder and the sintered magnet had a final composition of Nd: 22.8, Pr: 7.6, Dy: 1.0, Tb: 1.0, B: 1.05, Cu: 0.1, Al: 0.3, Nb: 0.5, and Fe: balance [mass %] was quenched by a strip casting method, whereby a plate-like alloy with a thickness of 0.1 to 0.3 mm was obtained.

This alloy was retained in a hydrogen-pressurized ambient by using a heat treatment furnace which was capable of pressurizing the alloy, and thereafter heated to 660° C. in a vacuum, and then cooled. After it was taken out of the furnace, a grain size adjustment was made with a sieve, whereby an alloy powder with a grain size of 425 μm or less was obtained.

The pulverization chamber of the apparatus used in this Example had a volumetric capacity of 314 $cm^3$. Herein, the pulverization gas was a nitrogen gas whose oxygen concentration was controlled to 8000 ppm or less. The pulverization gas pressure is a value expressing, in gauge pressure, the pressure of a pulverization gas to be introduced to the pulverization chamber.

By using the circulating flow pulverization apparatus 1 shown in FIGS. 2(*a*) and (*b*), fine pulverization was conducted while varying the supply rate and the residence time; the pulverization conditions and the particle sizes of the resultant powders are shown in Table 6.

As for Samples 15 and 16 shown in Table 6, after oxidization of the pulverized powder, from ten randomly-extracted particles of alloy powder for each Sample, contour shapes of the particles resulting from two-dimensional projection were assessed with commercially-available analysis software to assess whether the conditional expression $L/d \leq 5.39-1.07(a/b)$ was satisfied or not, and the proportion of the alloy powder that satisfied the conditional expression is shown.

TABLE 6

| No | pulverization gas | gauge pressure (MPa) | supply rate (g/min) | residence time (min) | D50 (μm) | proportion of alloy powder satisfying the conditional expression (%) |
|---|---|---|---|---|---|---|
| Sample 15 | nitrogen | 0.65 | 6.2 | 4 | 4.93 | 0 |
| Sample 16 | | 0.75 | 3.1 | 8 | 4.62 | 100 |

As shown in Table 6 above, Sample 16 contained alloy powder satisfying the conditional expression by 100%. On the other hand, Sample 15 contained no alloy powder that satisfied the conditional expression.

In order to measure magnetic characteristics, after the fine-pulverization step, slurries were made by using the alloy powders of Samples 15 and 16 with oil, and under conditions such that the direction of the applied magnetic field was orthogonal to the direction of pressurization in a 1.36 MA/m magnetic field, compacts were produced at a compacting pressure of 25 MPa.

Then, Samples 15 and 16 were sintered in a reduced-pressure Ar gas ambient, under the conditions of 1080° C. and four hours. Furthermore, the resultant sintered R-T-B based magnets were subjected to two hours of heat treatment at 500° C. in a vacuum ambient, and thereafter cooled.

After machining these Samples, their remanence $Br_r$, coercivity $H_{cJ}$, and alignment degree at room temperature were measured with a B-H tracer. The alignment degree was calculated as a tri-directional alignment degree similarly to Example 1.

TABLE 7

| No | Br (T) | HcJ (kA/m) | alignment degree |
|---|---|---|---|
| Sample 15 | 1.300 | 1660 | 0.981 |
| Sample 16 | 1.311 | 1683 | 0.992 |

As indicated by Table 6 and Table 7 above, in a comparison between Sample 15 for which the gauge pressure was 0.65 MPa and Sample 16 for which the gauge pressure was 0.75 MPa, Sample 16 (qualifying as Example) had an improved remanence $B_r$, improved coercivity $H_{cJ}$, and improved alignment degree over those of Sample 15, which was of the same composition.

EXAMPLE 4

To the main materials, which were Nd and Pr with a purity of 99.5% or more, electrolytic iron, and a low-carbon ferroboron alloy, additive elements (Co and M) were added as pure metals or as an alloy with Fe, and an alloy melt being melted so that the R-T-B based alloy powder and the sintered magnet had a final composition of Nd: 21.9, Pr: 7.3, B: 0.94, Co: 2.0, Cu: 0.1, Al: 0.05, Ga: 0.1, and Fe: balance [mass %] was quenched by a strip casting method, whereby a plate-like alloy with a thickness of 0.1 to 0.3 mm was obtained.

This alloy was retained in a hydrogen-pressurized ambient by using a heat treatment furnace which was capable of pressurizing the alloy, and thereafter heated to 580° C. in a vacuum, and then cooled. After it was taken out of the furnace, a grain size adjustment was made with a sieve, whereby an alloy powder with a grain size of 425 μm or less was obtained.

The pulverization chamber of the apparatus used in this Example had a volumetric capacity of 628 $cm^3$. Herein, the pulverization gas was helium gas. The pulverization gas pressure is a value expressing, in gauge pressure, the pressure of a pulverization gas to be introduced to the pulverization chamber.

By using the circulating flow pulverization apparatus 1 shown in FIGS. 2(*a*) and (*b*), fine pulverization was conducted while varying the supply rate and the residence time; the pulverization conditions and the particle sizes of the resultant powders are shown in Table 8.

As for Samples 17 and 18 shown in Table 8, after oxidization of the pulverized powder, from ten randomly-extracted particles of alloy powder for each Sample, contour shapes of the particles resulting from two-dimensional projection were assessed with commercially-available analysis software to assess whether the conditional expression $L/d \leq 5.39-1.07(a/b)$ was satisfied or not, and the proportion of the alloy powder that satisfied the conditional expression is shown.

TABLE 8

| No | pulverization gas | gauge pressure (MPa) | supply rate (g/min) | residence time (min) | D50 (μm) | proportion of alloy powder satisfying the conditional expression (%) |
|---|---|---|---|---|---|---|
| Sample 17 | helium | 0.65 | 5.8 | 4 | 3.14 | 0 |
| Sample 18 | | 0.85 | 3.0 | 8 | 2.51 | 100 |

As shown in Table 8 above, Sample 18 contained alloy powder satisfying the conditional expression by 100%. On the other hand, Sample 17 contained no alloy powder that satisfied the conditional expression.

In order to measure magnetic characteristics, after the fine-pulverization step, slurries were made by using the alloy powders of Samples 17 and 18 with oil, and under conditions such that the direction of the applied magnetic field was orthogonal to the direction of pressurization in a 1.36 MA/m magnetic field, compacts were produced at a compacting pressure of 15 MPa.

Then, Samples 17 and 18 were sintered in a reduced-pressure Ar gas ambient, under the conditions of 1040° C. and four hours. Furthermore, the resultant sintered R-T-B based magnets were subjected to two hours of heat treatment at 500° C. in a vacuum ambient, and thereafter cooled.

After machining these Samples, their remanence $Br_r$, coercivity $H_{cJ}$, and alignment degree at room temperature were measured with a B-H tracer. The alignment degree was calculated as a tri-directional alignment degree similarly to Example 1.

TABLE 9

| No | Br (T) | HcJ (kA/m) | alignment degree |
|---|---|---|---|
| Sample 17 | 1.439 | 1345 | 0.982 |
| Sample 18 | 1.450 | 1394 | 0.990 |

As indicated by Table 8 and Table 9 above, in a comparison between Sample 17 for which the gauge pressure was 0.65 MPa and Sample 18 for which the gauge pressure was 0.85 MPa, Sample 18 (qualifying as Example) had an improved remanence $B_r$, improved coercivity $H_{cJ}$, and improved alignment degree over those of Sample 17, which was of the same composition.

EXAMPLE 5

To the main materials, which were Nd, Pr, Dy and Tb with a purity of 99.5% or more, electrolytic iron, and a low-carbon ferroboron alloy, additive elements (Co and M) were added as pure metals or as an alloy with Fe, and an alloy melt being melted so that the R-T-B based alloy powder and the sintered magnet had a final composition of Nd: 22.5, Pr: 7.5, Dy: 0.1, Tb: 0.1, B: 0.90, Co: 0.9, Cu: 0.15, Al: 0.1, Ga: 0.5, Zr: 0.1, and Fe: balance [mass %] was quenched by a strip casting method, whereby a plate-like alloy with a thickness of 0.1 to 0.3 mm was obtained.

This alloy was retained in a hydrogen-pressurized ambient by using a heat treatment furnace which was capable of pressurizing the alloy, and thereafter heated to 550° C. in a vacuum, and then cooled. After it was taken out of the furnace, a grain size adjustment was made with a sieve, whereby an alloy powder with a grain size of 425 μm or less was obtained.

The pulverization chamber of the apparatus used in this Example had a volumetric capacity of 314 $cm^3$. Herein, the pulverization gas was argon gas. The pulverization gas pressure is a value expressing, in gauge pressure, the pressure of a pulverization gas to be introduced to the pulverization chamber.

By using the circulating flow pulverization apparatus 1 shown in FIGS. 2(*a*) and 2(*b*), fine pulverization was conducted while varying the supply rate and the residence time; the pulverization conditions and the resultant particle sizes are shown in Table 10.

As for Samples 19 and 20 shown in Table 10, after oxidization of the pulverized powder, from ten randomly-extracted particles of alloy powder for each Sample, contour shapes of the particles resulting from two-dimensional projection were assessed with commercially-available analysis software to assess whether the conditional expression $L/d \leq 5.39-1.07(a/b)$ was satisfied or not, and the proportion of the alloy powder that satisfied the conditional expression is shown.

TABLE 10

| No | pulverization gas | gauge pressure (MPa) | supply rate (g/min) | residence time (min) | D50 (μm) | proportion of alloy powder satisfying the conditional expression (%) |
|---|---|---|---|---|---|---|
| Sample 19 | argon | 0.65 | 5.7 | 4 | 4.91 | 0 |
| Sample 20 | | 0.75 | 2.8 | 8 | 4.63 | 100 |

As shown in Table 10 above, Sample 20 contained alloy powder satisfying the conditional expression by 100%. On the other hand, Sample 19 contained no alloy powder that satisfied the conditional expression.

In order to measure magnetic characteristics, after the fine-pulverization step, slurries were made by using the alloy powders of Samples 19 and 20 with oil, and under conditions such that the direction of the applied magnetic field was orthogonal to the direction of pressurization in a 1.36 MA/m magnetic field, compacts were produced at a compacting pressure of 25 MPa.

Then, Samples 19 and 20 were sintered in a reduced-pressure Ar gas ambient, under the conditions of 1060° C. and four hours. Furthermore, the resultant sintered R-T-B based magnets were subjected to two hours of heat treatment at 500° C. in a vacuum ambient, and thereafter cooled.

After machining these Samples, their remanence $Br_r$, coercivity $H_{cJ}$, and alignment degree at room temperature were measured with a B-H tracer. The alignment degree was calculated as a tri-directional alignment degree similarly to Example 1.

TABLE 11

| No | Br (T) | HcJ (kA/m) | alignment degree |
|---|---|---|---|
| Sample 19 | 1.392 | 1500 | 0.980 |
| Sample 20 | 1.406 | 1520 | 0.991 |

As indicated by Table 10 and Table 11 above, in a comparison between Sample 19 for which the gauge pressure was 0.65 MPa and Sample 20 for which the gauge pressure was 0.75 MPa, Sample 20 (qualifying as Example) had an improved remanence $B_r$, improved coercivity $H_{cJ}$, and improved alignment degree over those of Sample 19, which was of the same composition.

Examples of the present invention illustrated the two cases where the volumetric capacity of the pulverization chamber was 314 $cm^3$ and 628 $cm^3$. However, in accordance with how large the volumetric capacity is, the supply rate may be adjusted as appropriate so that the residence time of the alloy powder falls within the range of the present invention; the volumetric capacity does not pose a limitation.

INDUSTRIAL APPLICABILITY

An R-T-B based alloy powder according to an embodiment of the present invention is suitably used for producing a sintered R-T-B based magnet.

REFERENCE SIGNS LIST circulating flow pulverization apparatus
2 housing
2A pulverization chamber
3 coarse-pulverized powder supply port
4 coarse-pulverized powder supplying section
5 pulverization gas introduction nozzle
6 fine-pulverized powder discharge port
18 high speed circulating flow

The invention claimed is:

1. A production method of an R-T-B based alloy powder comprising:

a step of providing an alloy powder containing not less than 27.5 mass % and not more than 36.0 mass % of R (where R is at least one among the rare-earth elements and always includes at least one of Nd and Pr), not less than 0.85 mass % and not more than 1.05 mass % of B (boron), not less than 0.1 mass % and not more than 2.5 mass % of element M (where M is at least one selected from the group consisting of Al, Ti, V, Cr, Mn, Ni, Cu, Zn, Ga, Zr, Nb, Mo, Ag, In, Sn, Hf, Ta, W, Pb and Bi), and a balance T (where T is: Fe; or Fe and Co); and a step of pulverizing the alloy powder by introducing the alloy powder and a pulverization gas in a pulverization chamber of a jet mill, wherein the pulverization comprises attrition while circulating the alloy powder with a flow of the pulverization gas in the pulverization chamber, the pulverizing step being performed so as to satisfy the condition that the pulverization gas to be introduced in the pulverization chamber has a gauge pressure of 0.75 MPa or more and that a residence time of the alloy powder in the pulverization chamber is 6 minutes or more.

2. A production method of a sintered R-T-B based magnet comprising:

a step of obtaining an R-T-B based alloy powder by the method of claim 1; and a step of aligning the R-T-B based alloy powder with an external magnetic field and sintering the R-T-B based alloy powder.

3. The production method of claim 1, wherein the pulverizing step produces the R-T-B based alloy powder, in which 20% or more by number ratio of particles of the R-T-B based alloy powder satisfies the condition $L/d \leq 5.39-1.07(a/b)$, given a ratio a/b between a longer diameter a that represents a largest diameter of each contour shape and a shorter diameter b that represents a largest diameter of each contour shape in a direction orthogonal to the longer diameter a and given a ratio L/d between a circumferential length L and an equivalent circular diameter d, which is a diameter of a circle of an identical area, of contour shapes resulting from two-dimensional projection of the particles.

* * * * *